United States Patent [19]

Bulman

[11] Patent Number: 4,711,153

[45] Date of Patent: Dec. 8, 1987

[54] SEAL

[75] Inventor: Melvin J. Bulman, Colchester, Vt.

[73] Assignee: General Electric Company, Pittsfield, Mass.

[21] Appl. No.: 941,909

[22] Filed: Dec. 15, 1986

[51] Int. Cl.[4] ..... F41F 1/04

[52] U.S. Cl. ..... 89/7; 92/162 R; 92/247; 277/27

[58] Field of Search ..... 89/7, 26; 92/162 R, 92/247; 277/3, 27, 135

[56] References Cited

U.S. PATENT DOCUMENTS

| | | | |
|---|---|---|---|
| 2,369,883 | 2/1945 | Coopey | 277/135 |
| 3,285,142 | 11/1966 | Doll et al. | 92/162 R |
| 4,586,422 | 5/1986 | Magoon | 89/7 |

*Primary Examiner*—Stephen C. Bentley

*Attorney, Agent, or Firm*—Bailin L. Kuch

[57] ABSTRACT

This invention provides a seal mechanism between two mating surfaces by means of a progressively, but not necessarily uniformly, decreasing clearance gap between said two surfaces for the flow of leakage of liquid and which gap may change as a function of the pressure of the flow.

8 Claims, 9 Drawing Figures

SEAL

BACKGROUND OF THE INVENTION

1. Field of the Invention

This invention relates to seals for liquid high pressure systems such as liquid propellant guns.

2. Prior Art

Annular seals are well known, and are shown, for example, in Hasek, U.S. Pat. No. 2,117,885; Asbury, U.S. Pat. No. 1,376,130; Gerdom, U.S. Pat. No. 539,733; Thierry, U.S. Pat. No. 3,006,254; Wankel, Germany DAS No. 1,096,697; Ashley, U.S. Pat. No. 3,783,737; and Ashley, U.S. Pat. No. 3,996,837. Each of these seals functions by stressing a ring into abutment with a bore to provide a closed surface continuum, and is more or less effective for a limited number of firings. Tassie, in U.S. Pat. No. 4,050,352, issued Sept. 27, 1977, shows a liquid investment seal for the firing chamber of a liquid propellant gun; this seal is renewed at the commencement of each firing.

SUMMARY OF THE INVENTION

In any ultra-high pressure hydraulic system, such as, but not limited to, liquid propellant guns, seals are necessary to reduce the loss of liquid during operation of the system. In certain applications, a discrete seal mechanism is not feasible, but a small amount of leakage of liquid is tolerable or desirable.

An object of this invention is to provide a mechanism which achieves a non-discrete seal by means of a leakage of liquid which is minimal and controlled.

A feature of this invention is the provision of a seal mechanism between two mating surfaces, which may, for example, be a piston surface and a cylinder surface, by providing a progressively, but not necessarily uniformly, decreasing clearance gap between said two surfaces for the flow of leakage of liquid and which gap may change as a function of the pressure of the flow.

BRIEF DESCRIPTION OF THE DRAWING

These and other objects, features and advantages of the invention will be apparent from the following specification thereof taken in conjunction with the accompanying drawing in which:

FIG 1A is a detail of FIG. 1 showing relative pressures on the skirt of the differential piston;

DESCRIPTION OF THE INVENTION

Seals are vital to the proper function of high pressure hydraulic systems. Seals are necessary to reduce the leakage flow of the working fluid. Such leakage flow may have many detrimental consequences, of which the most significant occurs in a closed system wherein the lost liquid must be replaced. In such a case the leakage flow must be reduced to the minimum possible. In other systems, such as a single pass system, a small loss of liquid is acceptable, although minimization of the leakage flow is still desirable to minimize the power loss in the system caused by the leakage flow.

Many types of discrete seal mechanisms have been developed to minimize leakage flow. The conventionally used seal mechanism is an elastomeric type, e.g. O-ring seal which both as a static seal and a sliding seal under moderate pressures has adequate performance. Such seal mechanisms may be made of a material which is appropriate to the environment to which it is exposed. However, such seal mechanisms have inadequate performance at relatively high pressures or relatively large clearances, which frequently coexist. A L-seal may be used at relatively higher pressures but the tip of the foot of the seal tends to bind against the mating surface and to score it.

This invention is directed to a sealing mechanism which does not utilize a conventional discrete seal. In the firing of liquid propellant guns utilizing discrete seal mechanisms, it has been found that an unwanted ignition of monopropellant may occur around such a discrete seal mechanism. It is uncertain as to whether the cause of the ignition is the discrete seal mechanism, i.e. the O-ring seal, or the annular groove in which the seal is disposed. To avoid such ignition, it is desirable to provide a sealing mechanism that does not have either a discrete seal or a discrete groove. This invention provides a sealing mechanism utilizing, during operation, i.e. firing, a greatly reduced, from conventional practice, clearance or gap between the mating surfaces, but still not permitting physical contact between such mating surfaces, and self-compensating to accommodate a limited amount of wear of such mating surfaces.

Figure 14:
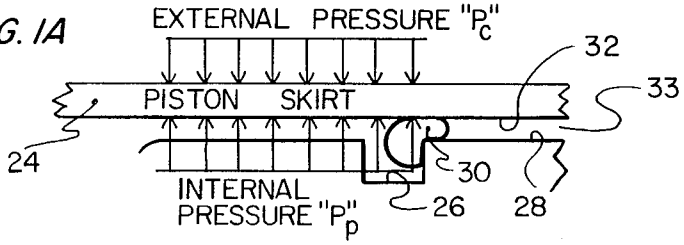
Figure 1:
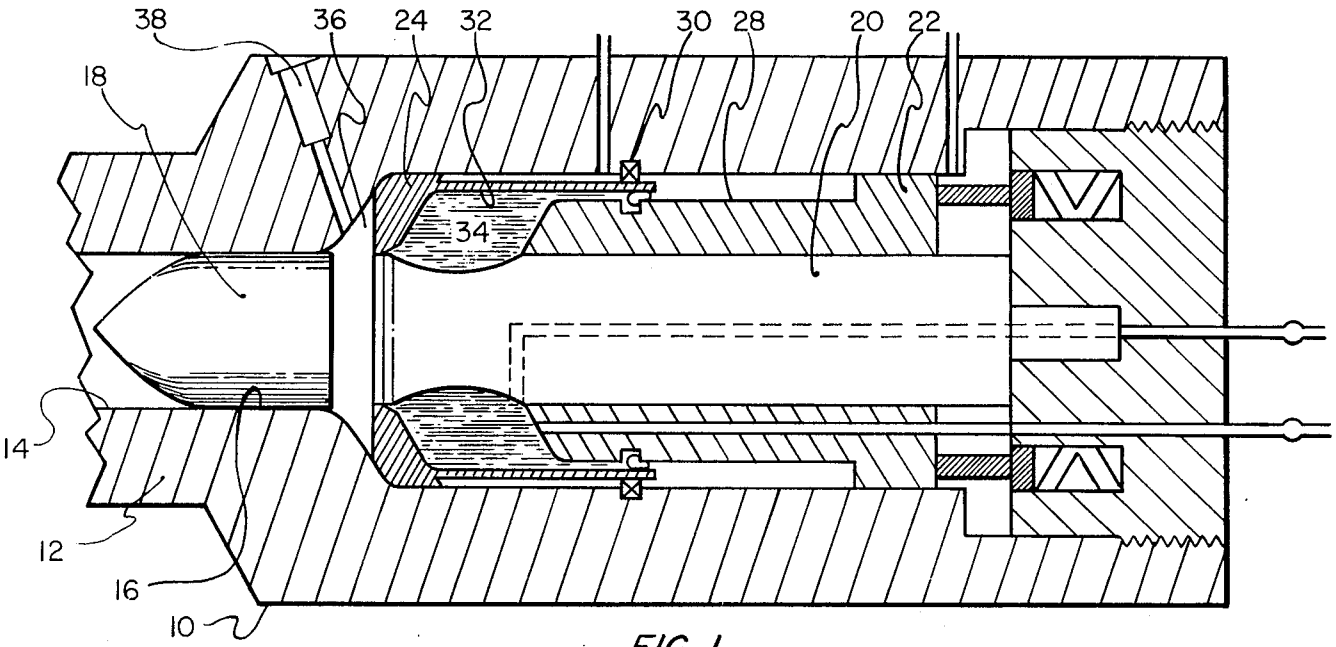
FIG. 1 is detail of an exemplary liquid propellant gun of the type shown by R. E. Mayer in U.S. Pat. No. 4,341,147 issued July 27, 1982; I. K. Magoon in U.S. Pat. No. 4,523,507, issued June 18, 1875; R. E. Mayer, et al. in U.S. Pat. No. 4,523,508, issued June 18, 1985; and I. K. Magoon, U.S. Pat. No. 4,586,422, issued May 6, 1986, all particularly showing a conventional O-Ring type seal mechanism under high pressure.

FIG. 1 is a detail of U.S. Pat. No. 4,523,507 issued Nov. 2, 1983 to I. K. Magoon, the disclosure of which is hereby incorporated by reference, and to which reference should be made for details not herein shown. The liquid propellant gun includes a housing 10 including a gun barrel 12 with a bore 14 and a chamber 16 into which a projectile I8 may be inserted. A stationary bolt 20 supports a fill piston or valve 22 which in turn supports a regenerative piston 24. A groove 26 in the external surface 28 of the fill piston carries an O-ring seal 30 against the internal surface 32 of the regenerative piston which is exemplary of the prior art to seal the clearance or gap 33. Liquid propellant is pumped into the pumping chamber 34 defined between the respective heads of the two pistons 22 and 24. A combustion chamber 36 is defined between the base of the projectile and the front face of the regenerative piston 24. An ignitor 38 generates an initial pressure in the combustion chamber 36 adequate to provide an initial aftward displacement of the regenerative piston 24 with respect to the stationary (fixed) bolt 20 to create an annular opening or gap between the bolt and piston through which liquid propellant is injected from the pumping chamber 34 into the combustion chamber 36. As shown in FIG 1A, due to the difference in cross-sectional areas of the forward and aft faces of the head of the regenerative piston 24, the pressure $P_p$ in the pumping chamber is higher than the pressure $P_c$ in the combustion chamber, e.g. $P_p=1.4$ $P_c$. $P_c$ is in the order of 40,000 to 60,000 p.s.i. The pressure on the exterior cylindrical surface 38 of the regenerative piston 24 is also equal to $P_c$. Under the pressure of 1.4 $P_c$ acting on the liquid propellant in the pumping chamber 34, the O-ring seal mechanism 30 extrudes into the clearance gap between the surface 28 and 32. This extrusion may damage the seal permitting leakage to occur. The clearance gap 33 increases as $P_p$ increases, since the pressure within the hollow regenerative piston 24 is significantly greater than that ($P_c$) outside the piston and tends to deflect the skirt of the piston 28 outwardly.

Figure 2A:
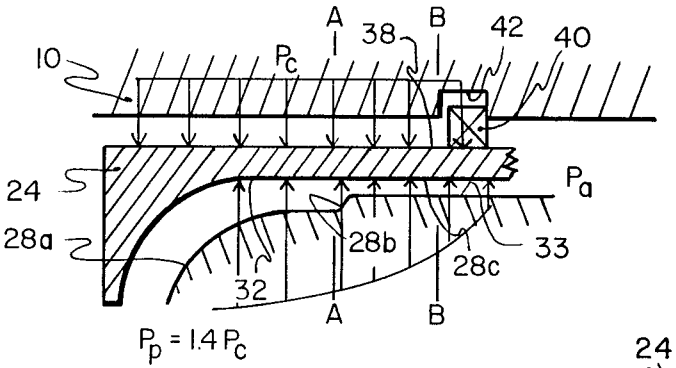
FIG. 2A is a detail of FIG. 2 showing relative pressures on the skirt of the differential piston.
Figure 2:
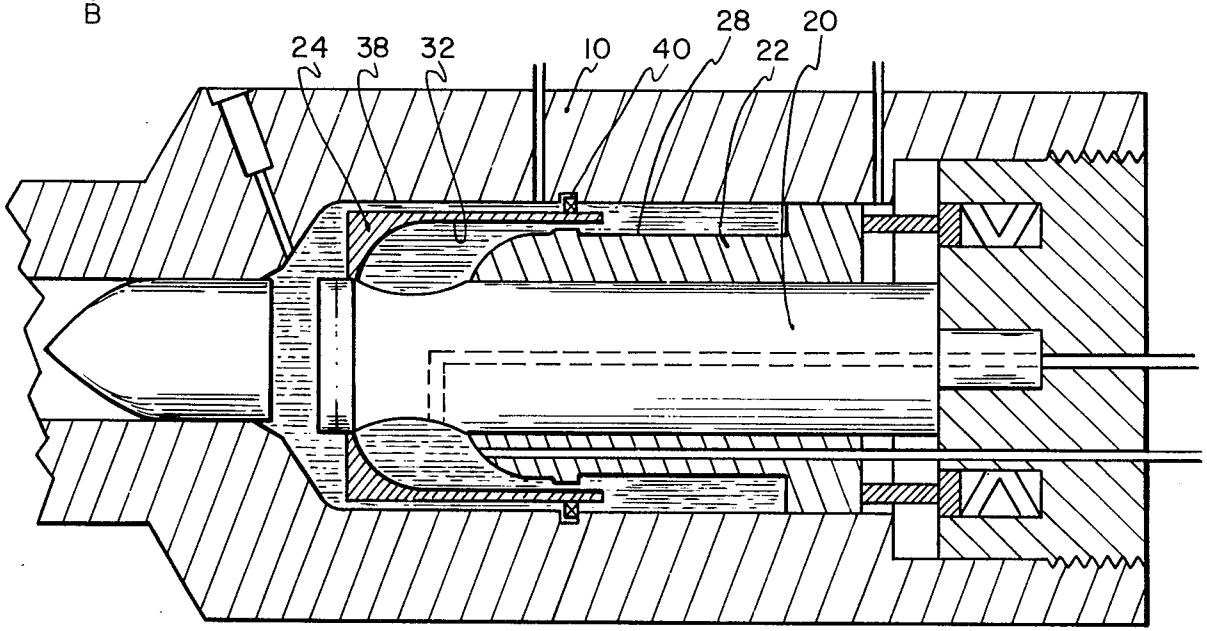
FIG. 2 is a detail of a gun similar to FIG. 1 but showing a passive, clearance control, seal mechanism between the annular outer differential piston and the inner fill piston and embodying this invention.

In the first embodiment of this invention, shown in FIG. 2, the prior art, discrete, O-ring seal mechanism between the respective surfaces 28 and 32 of the fill and the regenerative pistons, which mutually define the gap 33, is omitted, and a passive clearance control seal mechanism is substituted therefor. The initial static clearance gap 33 between the two surfaces 28 an 32 is made as small as is possible without risking binding of the regenerating piston, e.g. 0.001 inch on the radius. During firing, the pumping chamber pressure $P_p$ increases to a larger value than the combustion chamber pressure $P_c$ outside the skirt of the regenerative piston, e.g. $P_p=1.4$ $P_c$. If unchecked, this higher internal pressure $P_p$ would cause the clearance gap 33 to greatly increase, e.g. to 0.002 inch on radius. A clearance gap 33 of this magnitude would lead to a leakage loss of 10 to 30 percent of the propellant, whereas an acceptable leakage loss would be less than one percent. Such a reduced rate of leakage requires that the dimension of the clearance gap 33 be less during firing than during static conditions. This is achieved by generating, during firing, a region of relatively low pressure in the clearance gap 33 that pulls inwardly the skirt of the regenerative piston and thereby reduces the dimension of the clearance gap. The extent of this low pressure region is controlled by the respective shapes of the mating surfaces. These are shaped such that if the dimension of the clearance gap approaches zero, with a concomitant danger of seizing, a force will be generated tending to increase the dimension of the clearance gap. Thereby, a stable, small but not seizing, dimension of the clearance gap can be maintained.

This region of relatively low hydraulic pressure is created when the liquid propellant leakage flow passes through the clearance gap. The pressure is controlled by two effects. When the cross-sectional area of the gap decreases through which the flow passes, the velocity of the flow must increase, and the pressure in the flow must therefore decrease, according to Daniel Bernoulli's law of hydrodynamics. The pressure also decreases due to frictional losses when the flow passes through a long narrow passageway. The shape of the path of flow is determined by the shape of the annulus or gap 33 formed by the respective mating surfaces 28 and 32. The desired variation in cross-sectional area is a two to three fold reduction in area over a significant length of flow.

The deflection of the skirt of the piston results from the net external and internal pressures acting on it. As shown in FIG. 2A, the inner surface 32 of the differential piston 24 may be a relatively continuous, uniform diameter, cylindrical surface, while the exterior surface 28 of the fill piston 22 may be comprised of a leading, progressively enlarging diameter, cylindrical surface **28*a*, an intermediate, rapidly enlarging diameter, surface or discontinuity 28*b*, and a trailing, constant enlarging diameter, cylindrical surface 28*c*. The gap between the differential piston 24 and the housing 10 may be closed by a suitable seal 40 disposed in a groove 42 in the surface 32 and bearing against the surface 38. The pressure in the combustion chamber $P_c$ may be in the order of 40 k to 60 k p.s.i., the pressure $P_p$ in the pumping chamber will be in the order of 1.4 $P_c$, and the pressure $P_a$ at the discharge end of the leakage flow will be substantially atmospheric. At plane A, forward of the discontinuity 28*b*, where the gap, on radius, may be 0.002 inch, the pressure may be 0.7 $P_c$. At plane B, well aft of the discontinuity, the gap, on radius, is controlled by the balance of external and internal pressures, and may have an equilibrium value of 0.001 inch. The minimal leakage flow of liquid propellant which passes through this clearance gap also serves to cool and to lubricate the surfaces 32 and 28*c*** forming the gap.

Figure 3:
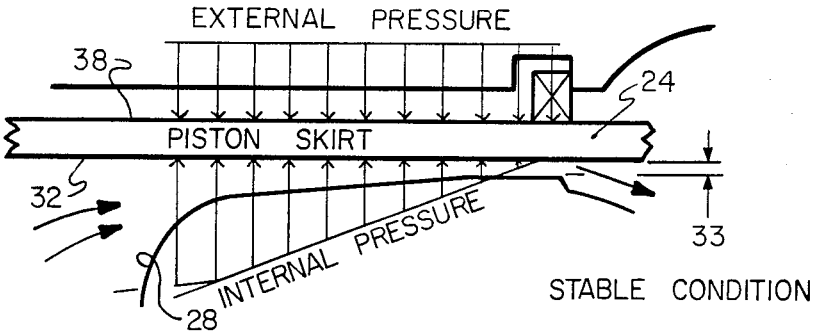
FIG. 3 is a detail of a gun similar to FIG. 2 showing an alternative contour of the passive, clearance control seal mechanism embodying this invention.

FIG. 3 shows a second embodiment of this invention wherein the discontinuity **28*b* is omitted and the surface 28 progressively curves aftwardly towards the inner surface 32 of the piston skirt to provide a progressively smaller annular clearance gap 33**. Here again the sealing mechanism conforms to Bernoilli's Theorem. The fluid pressure in the gap decreases in the direction of fluid flow. When the internal pressure on the piston skirt is less than the external pressure, the skirt is forced inwardly, tending to close the gap and halt the flow and increase the internal pressure until the internal and external pressures are in stable equilibrium.

Figure 4:
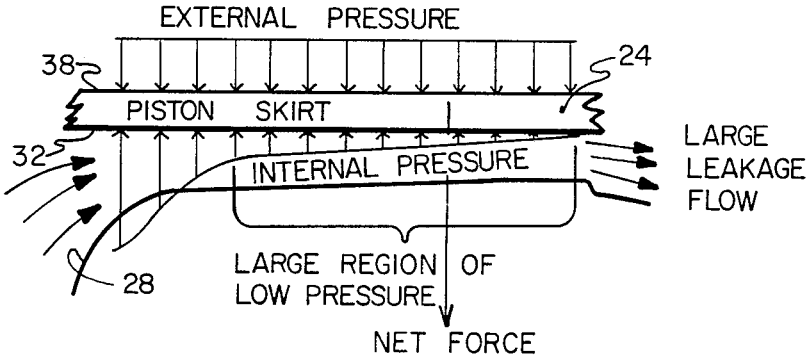
FIG. 4 is a detail of a gun similar to FIG. 3, but showing a clearance which is too large.

FIG. 4 is similar to FIG. 3 but shows a condition wherein the initial clearance gap is too large, providing a too large leakage flow and a too large region of high velocity flow and the sum of the forces developed by the pressures is directed centripetally and acts to close the gap toward the stable condition.

Figure 5:
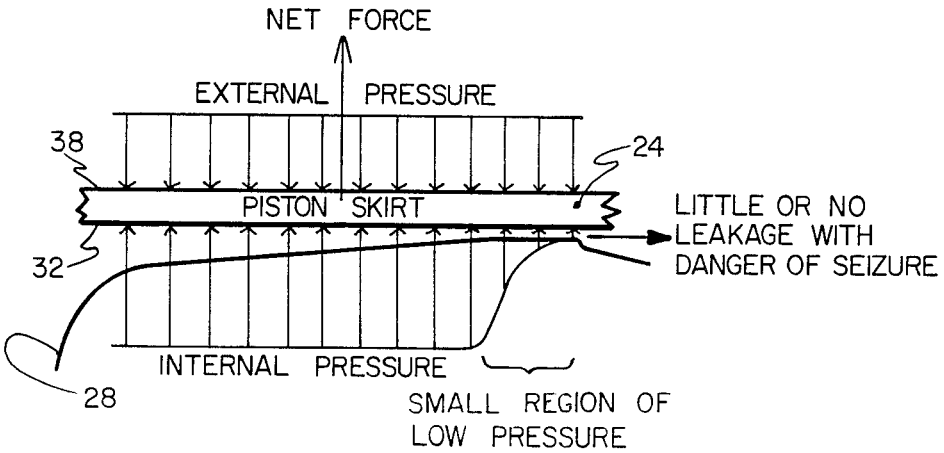
FIG. 5 is a detail of a gun similar to FIG. 3, but showing a clearance which is too small.

FIG. 5 is similar to FIG. 3 but shows a condition wherein the initial clearance gap is too small, providing a too small leakage flow and the sum of the forces developed by the pressures is directed centrifugally and acts to enlarge the gap toward the stable condition.

Figure 6:
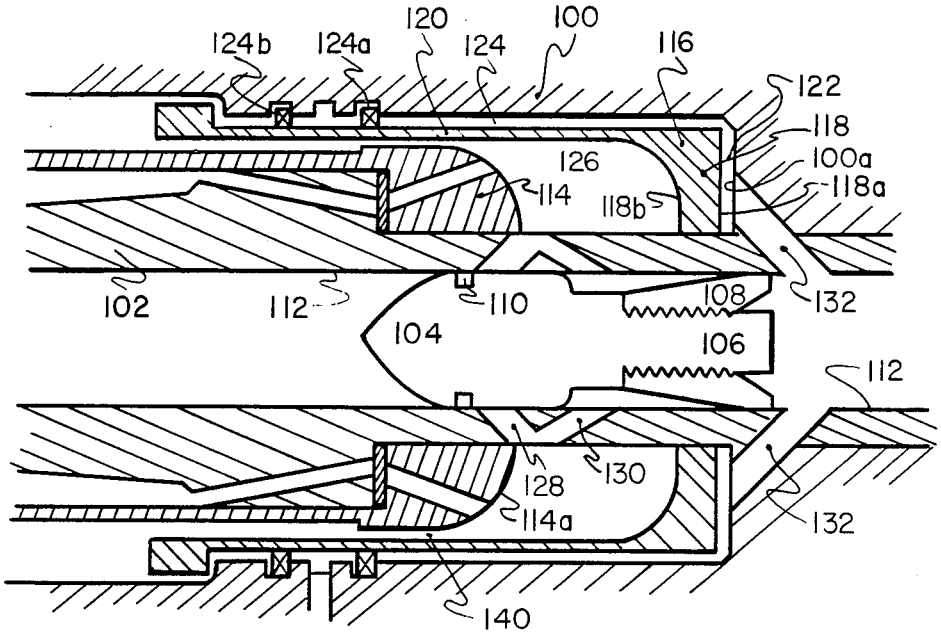
FIG. 6 is a detail of a gun similar to the type shown by M. J. Bulman, et al. in U.S. Ser. No. 677,151, filed Nov. 30, 1984.

FIG. 6 shows a third embodiment of the invention incorporated in a liquid propellant gun of the type shown by M. J. Bulman in Ser. No. 677,151, filed Nov. 30, 1984, the disclosure of which is hereby incorporated by reference and to which reference should be made for details not herein shown. The gun includes a housing 100 having an internal cavity in which is fixed a gun barrel 102. A projectile 104 having to hold back link 106, an annular flexible seal 108 and a firing band 110 is disposed in the bore 112 of the barrel. A reciprocable valve 114 is journaled on the barrel for fore and aft movement. A reciprocable differential piston 116 has a head 118 and a skirt 120 journaled on the valve head 114A. The aft face **118*a* of the piston head 118 and the forward interior face 100*a* of the housing define a combustion chamber 122. This combustion chamber communicates with the annular gap 124 between the housing 100 and the skirt 120 of the piston 116. The forward end of this gap is closed by a series of suitable seals 124*a*** and 124*b*. The forward face 118*b* of the piston head 118 and the aft face 114*a* of the valve head define a pumping chamber 126. The pumping chamber communicates with the gun barrel bore 112 via dual injector ports 128 and 130. The combustion chamber 122 communicates with the gun barrel bore 112 via ports 132. An annular gap 140 is provided between the skirt 120 of the piston and the valve head 114.

Figure 7:
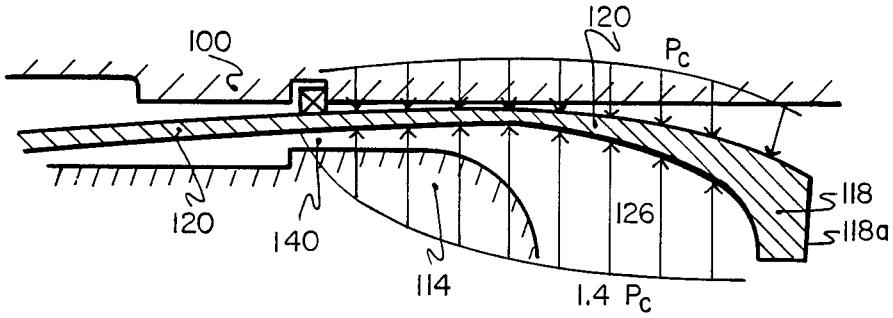
FIG. 7 is a detail of FIG. 6 showing relative pressures on the skirt of the differential piston.

In its static condition, the skirt 120 is substantially an annulus bounded by two concentric cylinders. However, upon firing, as shown in FIG. 7, the combustion chamber develops an internal pressure $P_c$ which is applied to the aft face 118*a* of the differential piston head 118 which causes an increased pressure on the liquid propellant in the pumping chamber 126 of $P_p = 1.4\ P_c$ which causes a centrifugal enlargement of the aft region of the skirt 120 which surrounds the pumping chamber and a concommitant increase, on radius, in the aft region of the gap 140. The gap 140 now has the wedge shaped longitudinal cross-section seen in FIG. 3, and the forward region of the skirt 120 is further deflected inward. Again, the higher the velocity of the leakage flow through the gap (plus any frictional losses) the lower the pressure, which will be less than $P_c$, tending to deflect the skirt centripetally to close the gap. But the closer to closing the gap becomes, tending to stop the flow, and to present full pumping pressure of 1.4 $P_c$, it tends to deflect the skirt centrifugally to maintain the gap open with a small equilibrium clearance and leakage.

In an exemplary mechanism the axial length of the clearance gap should be at least 1 inch and its transverse dimension 0.001 inch on radius or less for a ratio of 1000:1 or greater, while the piston skirt should have a distal portion of at least 1 inch in length and of a thickness and material which will permit centripetal deformation as a cantilever of substantially 0.001 inch on radius under the relevant combustion pressure (e.g. 40,000 p.s.i.).

I claim:

1. A sealing mechanism for a pump having:

a central journal;

a piston having a piston head and a skirt defining a central cavity, said skirt having its distal region disposed on said central journal with one end of said journal projecting into said cavity to define:

a pumping chamber between said projecting one end of said journal and said piston head, and a clearance gap between said journal and said piston skirt distal region and in fluid communication with said pumping chamber, characterized in that:

said skirt is so constructed and arranged as to be distorted centrifugally when the pressure within said gap is greater than the pressure external to said skirt and centripetally when the pressure within said gap is less than the pressure without said skirt, and having a mode of operation such that during compression of fluid within said pumping chamber a fluid pressure is developed within said pumping chamber which is greater than the pressure outside said piston and a flow of fluid leaks from said pumping chamber into and through said clearance gap whereby as such flow of fluid passes along the length of said clearance gap it develops a progressively lower pressure, becoming lower than said pressure outside said piston, whereby the distal region of said skirt is distorted centripetally to tend to close said clearance gap to tend to halt such flow.

2. A sealing mechanism according to claim 1 wherein:

said flow of fluid develops said progressively lower pressure as a result of a reduction in cross-sectional flow area.

3. A sealing mechanism according to claim 1 wherein:

said flow of fluid develops said progressively lower pressure, at least in part, as a result of boundary friction.

4. A sealing mechanism according to claim 1 wherein:

either or both of said journal and said skirt are so constructed and arranged as to provide said clearance gap.

5. A liquid propellant gun having:

a fill valve;

a piston having a piston head and a skirt defining a central cavity, said skirt having its distal region disposed on said fill valve with one end of said fill valve projecting into said cavity to define:

a pumping chamber between said projecting one end of said fill valve and said piston head, and a clearance gap between said fill valve and said piston skirt distal region and in fluid communication with said pumping chamber, characterized in that:

said skirt is so constructed and arranged as to be distorted centrifugally when the pressure within said gap is greater than the pressure external to said skirt and centripetally when the pressure within said gap is less than the pressure without said skirt, and having a mode of operation such that during compression of fluid within said pumping chamber a fluid pressure is developed within said pumping chamber which is greater than the pressure outside said piston and a flow of fluid leaks from said pumping chamber into and through said clearance gap whereby as such flow of fluid passes along the length of said clearance gap it develops a progressively lower pressure, becoming lower than said pressure outside said piston, whereby the distal region of said skirt is distorted centripetally to tend to close said clearance gap to tend to halt such flow.

6. A sealing mechanism according to claim 5 wherein:

said flow of fluid develops said progressively lower pressure as a result of a reduction in cross sectional flow area.

7. A sealing mechanism according to claim 5 wherein:

said flow of fluid develops said progressively lower pressure, at least in part, as a result of boundary friction.

8. A sealing mechanism according to claim 5 wherein:

either or both of said fill valve and said skirt are so constructed and arranged as to provide said clearance gap.

* * * * *